US009528228B2

(12) United States Patent
Allega

(10) Patent No.: US 9,528,228 B2
(45) Date of Patent: Dec. 27, 2016

(54) VEHICLE-MOUNTED GROUND MARKING SYSTEM AND METHOD

(71) Applicant: James Allega, Brecksville, OH (US)

(72) Inventor: James Allega, Brecksville, OH (US)

( * ) Notice: Subject to any disclaimer, the term of this patent is extended or adjusted under 35 U.S.C. 154(b) by 113 days.

(21) Appl. No.: 14/520,450

(22) Filed: Oct. 22, 2014

(65) Prior Publication Data

US 2016/0115656 A1 Apr. 28, 2016

(51) Int. Cl.

| | |
|---|---|
| ***E01C 23/22*** | (2006.01) |
| ***B05B 12/12*** | (2006.01) |
| ***B05B 9/04*** | (2006.01) |
| ***B05B 12/00*** | (2006.01) |
| ***B05B 13/00*** | (2006.01) |
| ***E01C 23/16*** | (2006.01) |

(52) U.S. Cl.

CPC ..... *E01C 23/22* (2013.01); *B05B 9/0409* (2013.01); *B05B 12/00* (2013.01); *B05B 12/124* (2013.01); *B05B 13/005* (2013.01); *E01C 23/163* (2013.01)

(58) Field of Classification Search

CPC ..... E01C 23/22; E01C 23/222
USPC ..... 404/84.05, 93, 94, 111
See application file for complete search history.

(56) References Cited

U.S. PATENT DOCUMENTS 5,368,232 A * 11/1994 Schroeder ..... A63C 19/08 239/150
5,486,067 A * 1/1996 Huynh ..... E01C 23/222 118/697
5,529,432 A * 6/1996 Huynh ..... E01C 23/222 118/668
5,529,433 A * 6/1996 Huynh ..... E01C 23/222 404/101
5,540,518 A * 7/1996 Wambold ..... E01C 23/222 404/84.05
5,549,457 A * 8/1996 Flores ..... E01C 19/176 404/111
6,010,079 A * 1/2000 Mayfield, Jr. ..... A01M 7/0014 239/159
6,021,959 A * 2/2000 Mayfield, Jr. ..... A01M 7/0014 239/165
6,074,693 A * 6/2000 Manning ..... B05B 12/12 118/697
6,330,503 B1 * 12/2001 Sharp ..... E01C 23/163 173/1

(Continued)

*Primary Examiner* — Gary Hartmann
(74) *Attorney, Agent, or Firm* — Pearne & Gordon LLP

(57) ABSTRACT

A ground marking system includes a position signal receiver configured to receive a position signal and generate current position information based on the position signal. A paint supply is configured to discharge paint onto ground beneath the paint supply. A first actuator is operatively connected to the paint supply for linearly moving the paint supply in both a first direction and a second direction opposite the first direction. A second actuator is operatively connected to the paint supply for controlling the discharge of paint from the paint supply. A memory device stores predetermined positional data. A processor is in communication with the position signal receiver and the memory device, and is configured to control linear movements of the first actuator based on the current position information received from the position signal receiver and the predetermined positional data stored in the memory device, and adjust a position of the paint supply.

19 Claims, 5 Drawing Sheets

(56) References Cited

U.S. PATENT DOCUMENTS

| | | | | |
|---|---|---|---|---|
| 7,029,199 | B2 * | 4/2006 | Mayfield | A63C 19/06 404/84.05 |
| 7,188,015 | B2 | 3/2007 | Lange | |
| 8,021,077 | B2 * | 9/2011 | Annese | E01C 19/004 118/305 |
| 8,160,782 | B2 * | 4/2012 | Harrison, Jr. | A01B 79/005 701/36 |
| 8,442,766 | B2 * | 5/2013 | Nielsen | G06Q 10/06 324/67 |
| 8,467,969 | B2 * | 6/2013 | Nielsen | G06Q 10/06 427/137 |
| 8,478,524 | B2 * | 7/2013 | Nielsen | G06Q 10/06 701/521 |
| 8,478,525 | B2 * | 7/2013 | Nielsen | G06Q 10/06 700/111 |
| 8,634,991 | B2 | 1/2014 | Douglas | |
| 8,903,643 | B2 * | 12/2014 | Nielsen | G01C 15/02 342/357.2 |
| 2012/0056020 | A1 * | 3/2012 | Philpotts | A63C 19/065 239/722 |
| 2012/0232762 | A1 * | 9/2012 | Van Bruggen | E01C 23/166 701/49 |
| 2014/0205744 | A1 * | 7/2014 | McNutt | E01C 23/22 427/8 |

* cited by examiner

VEHICLE-MOUNTED GROUND MARKING SYSTEM AND METHOD

BACKGROUND OF THE INVENTION

Field of the Invention

Embodiments of the present invention are directed the making of informational markings on a surface, such as the ground. More specifically, embodiments of the present invention relate to automated systems for making informational markings on a surface.

Description of Related Art

It is known to make informational markings on a surface, such as the ground, regarding locations. For example, prior to an excavation or other construction process, workers can make location markings on the ground to indicate where the excavation should occur. Following a set of construction plans, the workers lay out the locations for the markings. This can involve surveying the construction area and temporarily installing string lines to indicate the locations for the markings. After the string lines are installed, the ground adjacent (e.g., beneath) the string lines can be marked with paint. The paint is typically spray paint of a bright color and is applied manually. Once the ground is marked, the string lines can be removed. The process of marking locations on the ground can be labor intensive and time consuming.

BRIEF SUMMARY OF THE INVENTION

The following summary presents a simplified summary in order to provide a basic understanding of some aspects of the devices, systems, and methods discussed herein. This summary is not an extensive overview of the devices, systems, and methods discussed herein. It is not intended to identify critical elements or to delineate the scope of such devices, systems and methods. Its sole purpose is to present some concepts in a simplified form as a prelude to the more detailed description that is presented later.

In accordance with one aspect, provided is a ground marking system. The ground marking system comprises a position signal receiver configured to receive a position signal and generate current position information based on the position signal. A paint supply is configured to discharge paint onto ground beneath the paint supply. A first actuator is operatively connected to the paint supply for linearly moving the paint supply in both of a first direction and a second direction opposite the first direction. A second actuator is operatively connected to the paint supply for controlling the discharge of paint from the paint supply. A memory device stores predetermined positional data. A processor is in communication with the position signal receiver and the memory device. The processor is configured to control linear movements of the first actuator based on the current position information received from the position signal receiver and the predetermined positional data stored in the memory device and thereby adjust a position of the paint supply.

In accordance with another aspect, provided is a surface marking system. The surface marking system comprises a vehicle, and a hydraulic cylinder mounted on the vehicle and comprising an extensible rod. A valve is operatively connected to the hydraulic cylinder to control a flow of hydraulic fluid to the hydraulic cylinder. A movable frame is connected to the extensible rod and is linearly movable with the extensible rod. A GNSS receiver is mounted on the movable frame and is configured to receive GNSS signals and generate current position information based on the GNSS signals. A paint supply is mounted on the movable frame and is configured to discharge paint onto the surface beneath the paint supply. An actuator is mounted on the movable frame and is operatively connected to the paint supply for controlling the discharge of paint from the paint supply. A memory device stores predetermined positional data. A processor is in communication with the GNSS receiver and the memory device. The processor is configured to adjust a position of the GNSS receiver by controlling linear movements of the extensible rod based on the current position information received from the GNSS receiver and the predetermined positional data stored in the memory device.

In accordance with another aspect, provided is a method of marking a surface. The method comprises providing a marking vehicle. The marking vehicle comprises a position signal receiver, a paint supply, an actuator operatively connected to the paint supply, a memory device storing predetermined positional data, and a processor in communication with the position signal receiver and the memory device. The marking vehicle is driven along the surface, and while performing the step of driving the marking vehicle along the surface: the position signal receiver receives a position signal and generates current position information based on the position signal; the processor compares the predetermined positional data and the current position information; the processor controls linear movements of the actuator based on a result of the step of comparing the predetermined positional data and the current position information, to thereby adjust a position of the paint supply; and paint from the paint supply is applied to the surface.

DETAILED DESCRIPTION OF THE INVENTION

Figure 1:
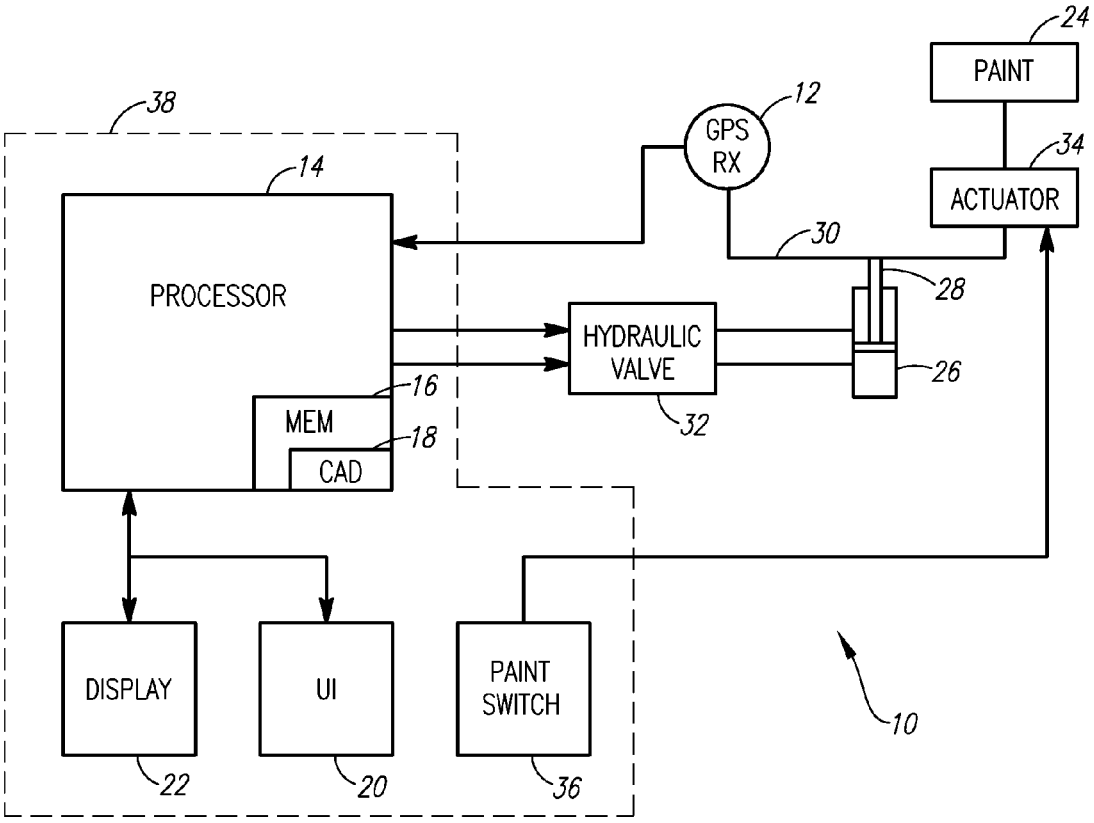
FIG. 1 is a block diagram of vehicle-mounted ground marking system.

Embodiments of the present invention relate to systems for making markings on a surface, such as the ground. The present invention will now be described with reference to the drawings, wherein like reference numerals are used to refer to like elements throughout. It is to be appreciated that the various drawings are not necessarily drawn to scale from one figure to another nor inside a given figure, and in particular that the size of the components are arbitrarily drawn for facilitating the understanding of the drawings. In the following description, for purposes of explanation, numerous specific details are set forth in order to provide a thorough understanding of the present invention. It may be evident, however, that the present invention can be practiced without these specific details. Additionally, other embodiments of the invention are possible and the invention is capable of being practiced and carried out in ways other than as described. The terminology and phraseology used in describing the invention is employed for the purpose of promoting an understanding of the invention and should not be taken as limiting.

FIG. 1 is a block diagram of a ground marking system 10. The system 10 is vehicle-mounted and processor-controlled, and is designed to allow an individual worker to drive the vehicle and mark the ground while driving. Using current position information (e.g., GPS data) obtained while driving, and stored predetermined positional data (e.g., constructions plans in a CAD format), the processor can automatically adjust the position of a paint supply mounted to the vehicle, to properly locate the paint supply so that the informational markings are accurately applied to the ground at correct locations in accordance with the stored predetermined positional data. The informational markings can thus be made quickly due to the speed of the vehicle, and without conducting surveys and installing temporary string lines in advance.

The system 10 can be used to make paint markings on a surface over which the vehicle is driven. Such paint markings include road surface markings on a roadway (e.g., lane lines), construction markings on the ground, etc. The surface over which the vehicle is driven can be the ground, such as undisturbed soil, an excavated or graded surface, roadbed, etc., or the surface can be a more finished surface, such as a paved surface (e.g., concrete or asphalt roadway, airport runway, parking lot, etc.) The terms "ground" and "surface" are used interchangeably herein, and both terms refer to a surface upon which the vehicle travels and upon which informational markings are made. The terms "ground" and "surface" refer to both finished and unfinished surfaces, such paved surfaces, unpaved surfaces, graded surfaces, surfaces to be excavated, original ground lines or elevations, undisturbed soil, etc.

The ground is marked using paint from a paint supply attached to the vehicle. As used herein, the term "paint" refers to any suitable marking agent that can be used to make informational markings on a surface. Thus, the term "paint" includes, but is not limited to, conventional spray paints, roadway lane marking paints, dyes, inks, pigments, and the like.

The ground marking system 10 includes a position signal receiver 12 that is configured to receive a position signal and generate current position information based on the position signal. The current position information includes data that identifies the current position of the position signal receiver 12. The position of the position signal receiver 12 changes as the vehicle is driven, and the position signal receiver can update the current position information periodically, such as several times per second. The position signal receiver 12 communicates with a processor 14 and periodically transmits the current position information to the processor. The position signal receiver 12 and the processor 14 can communicate wirelessly or through a wired connection.

One example of a position signal receiver 12 is a global navigation satellite system (GNSS) receiver. GNSS receivers receive GNSS signal transmissions from satellites in orbit and, based on the time of travel of each of the transmissions, determine the position of the GNSS receiver. GNSS receivers include Global Positioning System (GPS) receivers and receivers for the Galileo and GLONASS systems. An example of a GPS receiver that can be used with the ground marking system 10 is a TRIMBLE MS992 GNSS Smart Antenna. Other example position signal receivers 12 include laser receivers, total station targets, and the like.

The processor 14 is an electronic controller and can include one or more of a microprocessor, a microcontroller, a digital signal processor (DSP), an application specific integrated circuit (ASIC), a field-programmable gate array (FPGA), discrete logic circuitry, or the like. The processor 14 includes associated memory 16 that can store program instructions that cause the processor to provide the functionality ascribed to it herein. The memory 16 may include one or more volatile, non-volatile, magnetic, optical, or electrical media, such as read-only memory (ROM), random access memory (RAM), electrically-erasable programmable ROM (EEPROM), flash memory, or the like. The memory 16 is shown schematically in FIG. 1 as being part of the processor 14. However, portions of the memory 16 can be separate from the processor 14, such as a separate flash or hard drive, CD-ROM, etc., and the memory 16 can include several separate memory portions if desired.

The processor 14 communicates with both of the position signal receiver 12 and the memory 16. The memory 16 stores predetermined positional data 18 that is used to determine the proper location for the informational markings to be made on the ground. The predetermined positional data 18 can be stored in the memory 16 using a user interface 20, such as a keypad, touchscreen, etc., that communicates with the processor. The predetermined positional data 18 can also be downloaded to the memory 16 from a file or a remote database. In certain embodiments, the predetermined positional data 18 is included in one or more CAD (computer-aided design) files that are stored in the memory 16. The CAD files can be construction plans, and the informational markings to be made on the ground can convey information about the construction plans to workers, such as the locations of trenches, property boundaries, etc. Example CAD file formats include .DXF files, .DWG files, .DGN files, and the like. The predetermined positional data 18 can also be included in mapping software run on the processor 14 or otherwise accessible to the processor.

In addition to a user interface 20, the ground marking system 10 can include a display 22 for display and selecting the predetermined positional data 18. The display 22 can, for example, display the CAD file stored in the memory 16 and allow the user to select the predetermined positional data 18 from the displayed CAD file. Using the display 22 and/or user interface 20, the user can select one or more lines from the displayed CAD file as the predetermined positional data 18. The selected line(s) can be highlighted on the display 22 so that the user can confirm that the correct predetermined positional data 18 has been selected. For example, if a trench for a drain line is to be excavated, and the location of the excavation is to be marked on the ground prior to excavation, the drain line (and its associated location information) can be selected in the displayed CAD file as the predetermined positional data 18. The processor 14 is thus programmed with the predetermined positional data 18 from the CAD file by the user. If desired, the user can also enter an offset distance relative to the predetermined positional data 18 using the user interface 20. For example, if the user desires to make informational markings at a particular offset distance from stored predetermined positional data (e.g., 12 inches to one side of the location of the drain line), such an offset can be entered by the user, and the offset can be accounted for by the processor 14 when positioning the paint supply as discussed below.

Figure 2:
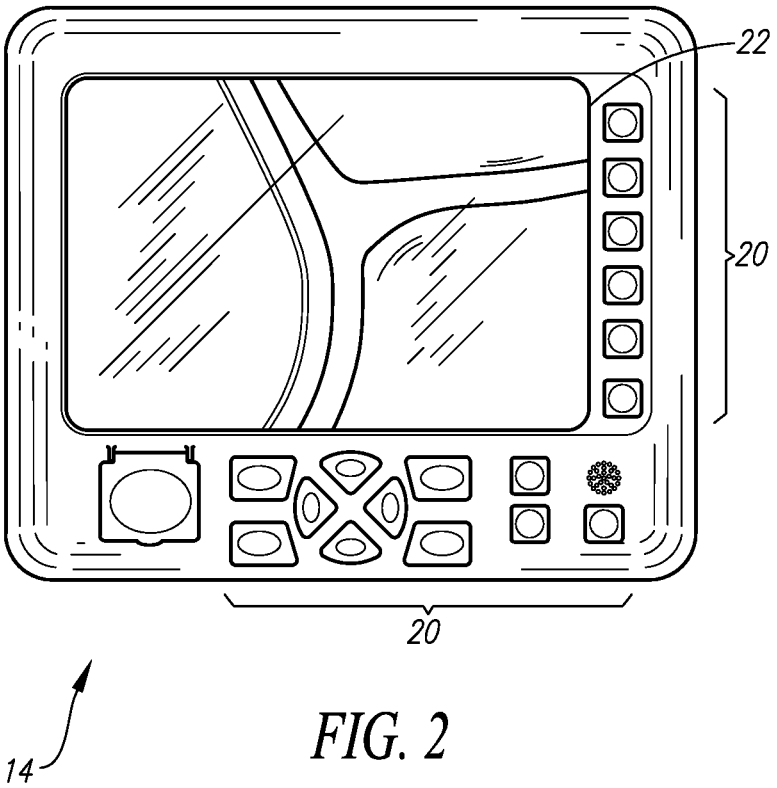
FIG. 2 is a view of a portion of a vehicle-mounted ground marking system.

FIG. 2 shows an example of a processor 14 with an integral display 22 and user interface 20. The user interface 20 includes a plurality of pushbutton switches for entering data into the processor 14. The display 22 is displaying a CAD file, from which the predetermined positional data can be selected, using the display itself (if it is a touchscreen), or using the user interface 20. For example, the user can select one of the displayed lines from the CAD file as the predetermined positional data, and enter an offset distance if desired.

With reference to FIG. 1, the processor 14 periodically (e.g., several times per second) receives the current position information from the position signal receiver 12. While the marking vehicle is driven, the processor 14 compares the current position information to the predetermined positional data 18. The processor 14 has outputs for controlling an actuator. The actuator adjusts the position of the paint supply 24 under the control of the processor 14. Based on the comparison between the current position information and the predetermined positional data 18, and any desired offset distance, the processor controls the operations of the actuator so that paint is applied to the ground at the correct location.

In certain embodiments, the position signal receiver 12 and paint supply 24 are connected together, and the processor 14 adjusts the position of the positional signal receiver to match the predetermined positional data 18. Since the position signal receiver 12 and paint supply are connected, adjusting the position of the position signal receiver 12 serves to also adjust the position of the paint supply 24. Alternatively, the position signal receiver 12 could be mounted at a fixed position wherein its relative position to the movable paint supply 24 is readily determinable by the processor 14.

Various types of actuators could be used to correctly position the paint supply 24 for making informational markings on the ground. In certain embodiments, the actuator is a linear actuator that moves the paint supply 24 (and position signal receiver 12 if connected to the paint supply) back and forth along a linear axis of movement. Example linear actuators include hydraulic actuators, pneumatic actuators, lead screws, etc.

In FIG. 1, the actuator for positioning the paint supply 24 and the position signal receiver 12 is a hydraulic cylinder, in particular a double acting hydraulic cylinder 26. The double acting hydraulic cylinder 26 has an extensible and retractable rod 28 that is attached to a movable frame 30. The position signal receiver 12 and paint supply 24 are mounted within the movable frame 30. As the rod is moved linearly (i.e., extended and retracted) by pressurized hydraulic fluid in the cylinder 26, the movable frame 30, position signal receiver 12 and paint supply 24 also move linearly.

A hydraulic directional control valve 32 controls the flow of hydraulic fluid to the double acting hydraulic cylinder 26. Thus, the valve 32 controls the back and forth linear movements of the rod 28. One example valve 32 is a double solenoid spool valve. Operations of the valve 32 are controlled by the processor 14. The processor 14 can compare the current position information received from the position signal receiver 12 to the predetermined positional data 18 and, accounting for any offset distance, control the valve 32 to adjust the position of the position signal receiver/paint supply. The processor 14 can frequently (e.g., several times per second) adjust the position of the position signal receiver/paint supply so that the position signal receiver/paint supply substantially follows the predetermined positional data 18. The processor 14 can be configured to selectively apply power (e.g., 12 VDC) to solenoids in the valve 32 to thereby control the flow of hydraulic fluid to extend and retract ports on the cylinder 26.

The operations of the valve 32 can also be manually controlled, if desired. For example, the vehicle can include an auto/manual control switch (not shown) that controls whether the solenoids in the valve 32 are operated by the processor 14 or by additional controls in the vehicle. When the auto/manual control switch is in the auto position, the valve will operate according to the outputs from the processor 14. To disable auto control of the valve 32 and cylinder 26, the auto/manual control switch can be placed in the manual position. Alternatively, the vehicle can include an auto/off control switch that either enables auto control of the valve 32 by the processor 14 or disables operation of the valve. In either case, such control switches can be part of the user interface 20 or be provided as separate control switches located within the vehicle.

An example marking operation will now be described. First, the appropriate CAD file can be opened and displayed on the display 22, and the predetermined positional data selected from the CAD file. The display 22 can show the selected predetermined positional data in a highlighted form, and can also show the current location of the vehicle on the displayed CAD file. The vehicle's operator can then drive the vehicle to the physical location corresponding to the predetermined positional data (e.g., by following the displayed CAD file). Once the vehicle is properly positioned, the operator can place the valve 32 in auto mode (e.g., by moving an auto/manual switch to the auto position) so that the valve is controlled by the processor 14. The valve 32 will then respond to control signals from the processor 14. The control signals can be "out" and "in" signals corresponding to extensions and retractions of the rod 28 from the cylinder 26. As the operator drives the vehicle along or adjacent the predetermined positional data (e.g., along a path to be excavated or roadway to be striped) to mark the location of the predetermined positional data on the ground, the processor 14 will compare the current position information from the position signal receiver 12 to the predetermined positional data and, accounting for any offset distance, adjust the position of the rod in and out so that the position signal receiver/paint supply follows predetermined positional data.

A paint actuator 34, such as a solenoid, is mounted on the movable frame 30 to control the discharge of paint onto the ground beneath the paint supply 24. If the paint supply 24 is a can of spray paint, the paint actuator 34 can operate a lever or arm that triggers the paint to spray out of the can. The vehicle can include a paint switch 36 that is activated by the operator to discharge the paint. Power to the solenoid (e.g., 12 VDC) can be controlled by the paint switch 36. The paint switch 36 can be a pushbutton that the operator presses intermittently to paint a dashed line on the ground. Alternatively, the paint switch 36 can be an input to the processor 14, which controls the operations of the paint actuator 34. In certain embodiments, the paint switch 36 is incorporated into the user interface 20. It is to be appreciated that as the operator drives the vehicle following the predetermined positional data while discharging paint at arbitrarily selected intervals (or continually if a stripe is desired) using the paint switch 36, the processor 14 actuates the rod 28 in and out so that the position signal receiver/paint supply accurately follows the predetermined positional data. Thus, the location of the predetermined positional data can be correctly marked on the ground substantially automatically.

An operator compartment 38 of the vehicle for the ground marking system 10 is shown schematically in FIG. 1. The processor 14, display 22, user interface 20 and/or paint switch 36 can be mounted in the operator compartment 38 so as to be readily accessible to the operator while driving the vehicle.

Figure 3:
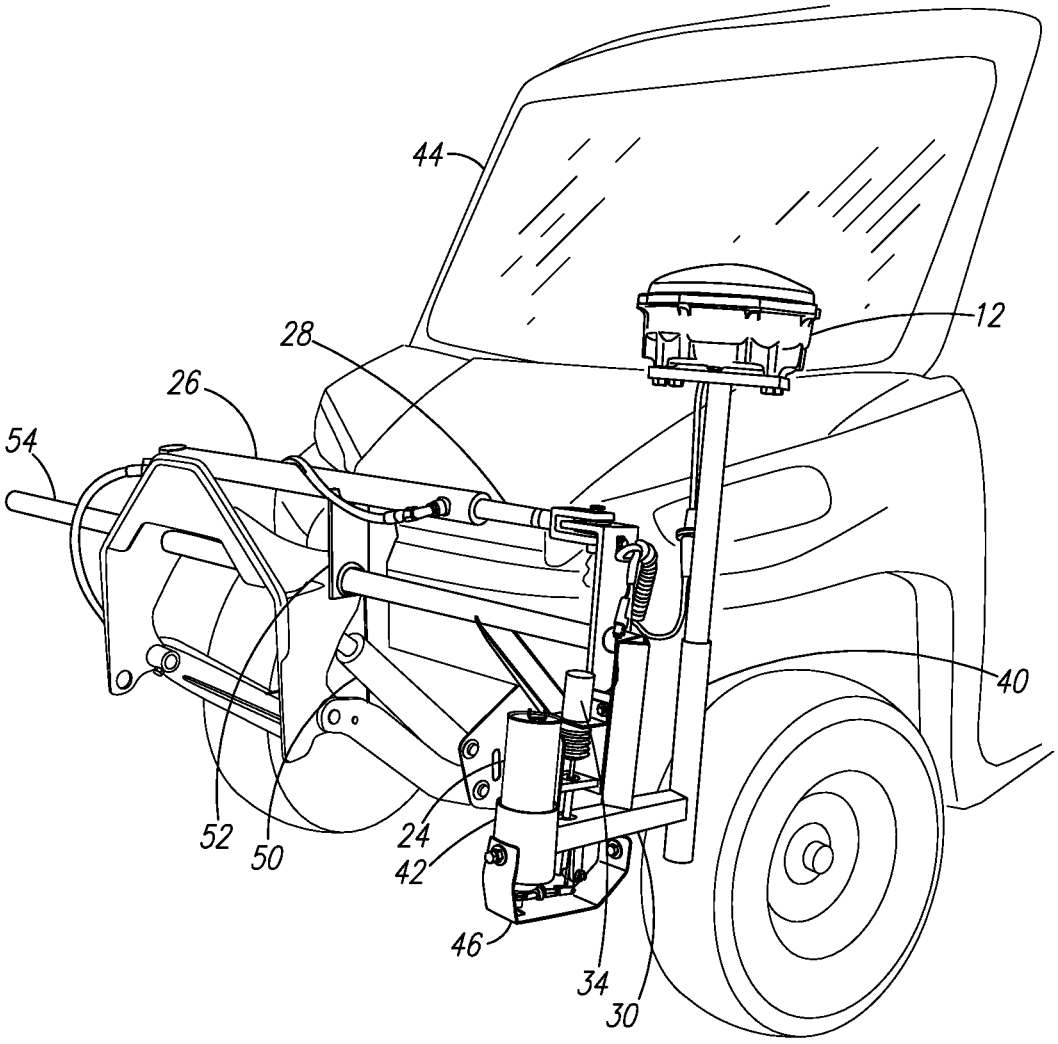
FIG. 3 is a perspective view of a portion of a vehicle-mounted ground marking system.
Figure 4:
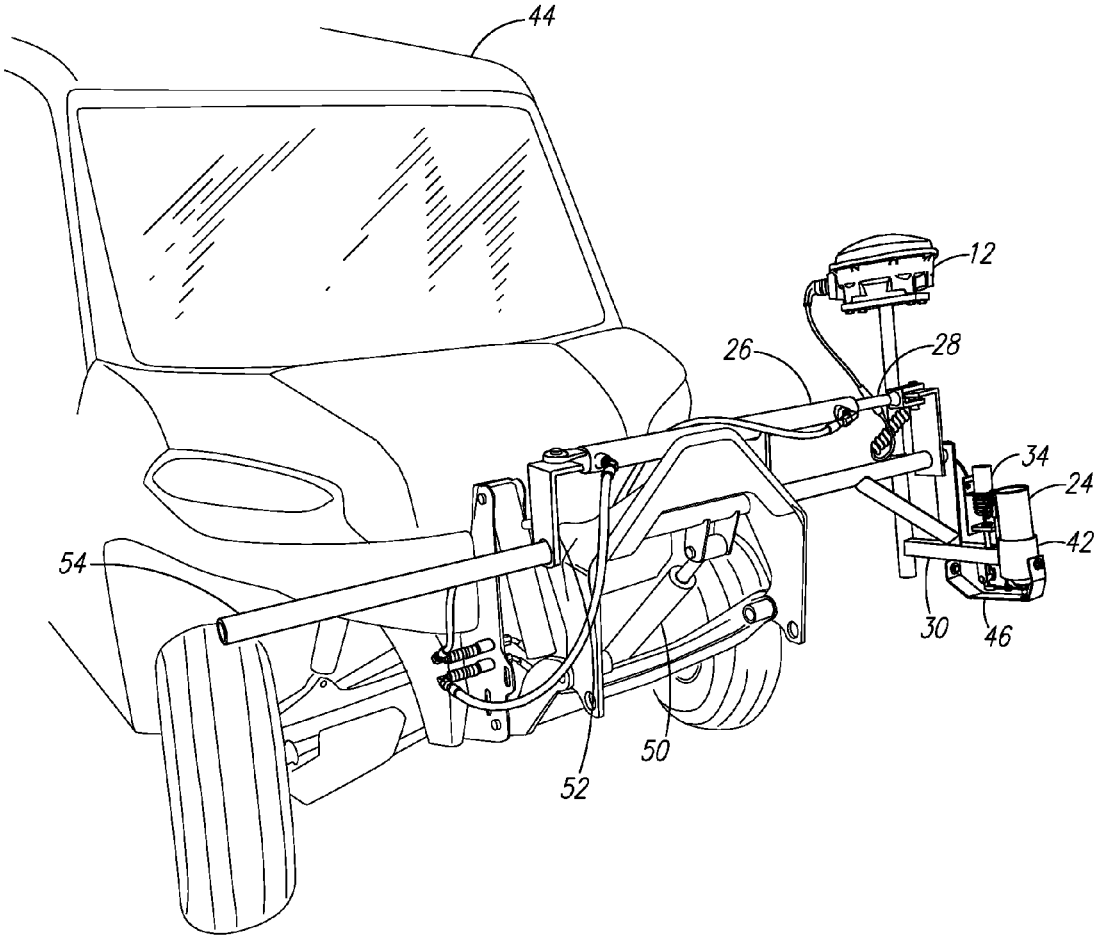
FIG. 4 is a perspective view of a portion of a vehicle-mounted ground marking system.
Figure 5:
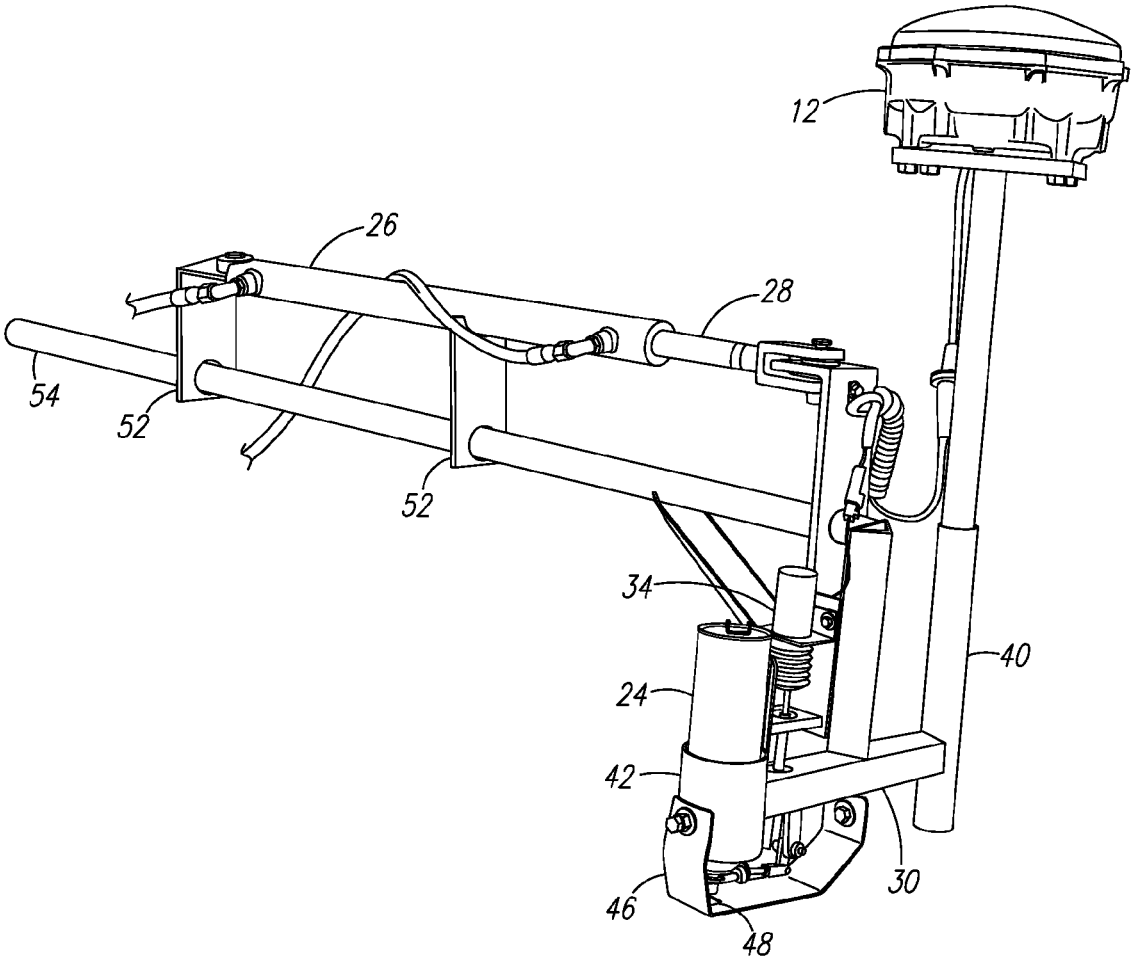
FIG. 5 is a perspective view of a portion of a vehicle-mounted ground marking system.

FIGS. 3-5 show structural details of the vehicle-mounted ground marking system. Portions of the ground marking system are shown mounted to a vehicle 44 in FIGS. 3 and 4, whereas the vehicle is not shown in FIG. 5.

The movable frame 30 is attached to the end of the rod 28 of the double acting hydraulic cylinder 26. The movable frame 30 hangs generally downward from the rod 28 toward the ground. The position signal receiver 12 and the paint supply 24 are mounted to the movable frame 30. The movable frame 30 can include dedicated holders 40, 42 for the position signal receiver 12 and paint supply 24. In an embodiment, the holders 40, 42 have the form of tubular sleeves from which the position signal receiver 12 and paint supply 24 can be readily removed. The holders 40, 42 can include other mounting hardware, such as clamps for example. The holders 40, 42 establish fixed relative positions between the position signal receiver 12 and the paint supply 24. In the example embodiment shown, the paint supply 24 and the position signal receiver 12 are offset from each other in the direction of travel of the vehicle 44, so that as the vehicle travels along the predetermined positional data, both the position signal receiver 12 and paint supply 24 can follow the predetermined positional data together. Thus, by controlling the cylinder 26 to make the position signal receiver 12 follow the predetermined positional data, the paint supply 24 will necessarily also follow the predetermined positional data.

Also mounted to the movable frame 30, adjacent the paint supply 24, is the paint actuator 34. Beneath the paint supply 24 between the paint supply and the ground is a skid 46. The skid 46 forms an aperture 48 through which paint is discharged onto the ground. In certain embodiments, the vehicle 44 includes a second hydraulic cylinder 50 for raising and lowering the paint supply 24 and other components of the system. The skid 46 can protect the paint supply 24 during use and prevent the paint supply from being driven into the ground when lowered. The aperture 48 can help to create a crisp paint line on the ground. The skid 46 can be offset to a side of the paint supply 24 if desired, rather than being mounted directly beneath the paint supply.

The ground marking system 10 can include structural components that help support the movable frame 30, so that the weight of the movable frame is not entirely borne by the cylinder 26 and rod 28. For example, the system 10 can include a fixed frame 52 attached to the vehicle 44. Unlike the movable frame 30, the fixed frame 52 does not move with the rod 28 perpendicular to the direction of travel of the vehicle 44. However, the fixed frame 52 can move up and down by operation of the second hydraulic cylinder 50. The fixed frame 52 holds a linearly-movable support bar 54 that is attached to the movable frame 30. The linearly-movable support bar 54 is designed to withstand a torque or moment applied by the weight of the movable frame 30, so that the torque is not entirely applied to the rod 28. The linearly-movable support bar 54 is oriented generally parallel to the cylinder and rod 28 and moves linearly within the fixed frame 52. The linearly-movable support bar 54 can also move up and down by operation of the second hydraulic cylinder 50. In certain embodiments, the second hydraulic cylinder 50 can selectively raise and lower together each of the fixed frame 52, the movable frame 30, the double acting hydraulic cylinder 26 and the linearly-movable support bar 54. Thus, the major mechanical components of the system 10 can be raised away from the ground when not in use, and selectively lowered for use. The operator compartment of the vehicle 44 can have suitable controls for allowing the operator to control the operations of the second hydraulic cylinder 50.

In certain embodiments, the second hydraulic cylinder 50 and components of the fixed frame 52 can be part of a system for supporting and moving various implements, such as a snowplow blade.

Components of the ground marking system are shown as mounted at the front of the vehicle 44. However, it is to be appreciated that such components could be mounted at other locations on the vehicle, such as along a lateral side of the vehicle or at the rear of the vehicle.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A ground marking system, comprising:

a position signal receiver configured to receive a position signal and generate current position information based on the position signal;

a paint supply configured to discharge paint onto ground beneath the paint supply;

a first actuator operatively connected to the paint supply for linearly moving the paint supply in both of a first direction and a second direction opposite the first direction;

a second actuator operatively connected to the paint supply for controlling the discharge of paint from the paint supply;

a memory device storing predetermined positional data; and a processor in communication with the position signal receiver and the memory device, wherein the processor is configured to control linear movements of the first actuator based on the current position information received from the position signal receiver and the predetermined positional data stored in the memory device and thereby adjust a position of the paint supply, wherein:

the ground marking system is mounted to a vehicle, the first actuator comprises a double acting hydraulic cylinder having an extensible and retractable rod, and the first actuator comprises a valve for controlling operations of the double acting hydraulic cylinder, the processor is operatively connected to the valve to control operations of the valve based on the current position information received from the position signal receiver and the predetermined positional data stored in the memory device, and the ground marking system further comprises a movable frame that is attached to the rod of the actuator and that includes a paint supply holder for mounting the paint supply such that the movable frame moves with the paint supply in both of the first direction and the second direction.

2. The ground marking system of claim 1, wherein the position signal receiver is connected to the paint supply and the first actuator such that the position signal receiver moves with the paint supply in both of the first direction and the second direction.

3. The ground marking system of claim 1, wherein the predetermined positional data is included in a CAD file stored in the memory device.

4. The ground marking system of claim 3, further comprising a display device operatively connected to the processor for displaying the CAD file; and a user interface operatively connected to the processor and configured for allowing a user to select the predetermined positional data from the displayed CAD file.

5. The ground marking system of claim 4, wherein the processor is configured to control operations of the valve based on the current position information received from the position signal receiver, the predetermined positional data stored in the memory device, and an offset distance, relative to the predetermined positional data, entered via the user interface.

6. The ground marking system of claim 1, wherein the second actuator comprises a solenoid configured to control the discharge of paint from the paint supply, the system further comprising a switch located within an operator compartment of the vehicle for controlling operations of the solenoid.

7. The ground marking system of claim 1, wherein the position signal receiver is a global navigation satellite system (GNSS) receiver.

8. The ground marking system of claim 1, wherein the movable frame includes a skid mounted between the paint supply and the ground beneath the paint supply, the skid forming a paint aperture through which paint is discharged onto the ground beneath the skid.

9. The ground marking system of claim 1, further comprising:

a fixed frame, and a linearly-movable support bar extending between the fixed frame and the movable frame, wherein the linearly-movable support bar moves linearly within the fixed frame and substantially parallel with the rod of the double acting hydraulic cylinder.

10. The ground marking system of claim 9, further comprising a second hydraulic cylinder configured for selectively raising and lowering together each of the fixed frame, the movable frame, the double acting hydraulic cylinder and the linearly-movable support bar.

11. A ground marking system, comprising:

a position signal receiver configured to receive a position signal and generate current position information based on the position signal;

a paint supply configured to discharge paint onto ground beneath the paint supply;

a first actuator operatively connected to the paint supply for linearly moving the paint supply in both of a first direction and a second direction opposite the first direction;

a second actuator operatively connected to the paint supply for controlling the discharge of paint from the paint supply;

a memory device storing predetermined positional data; and a processor in communication with the position signal receiver and the memory device, wherein the processor is configured to control linear movements of the first actuator based on the current position information received from the position signal receiver and the predetermined positional data stored in the memory device and thereby adjust a position of the paint supply, wherein the ground marking system is mounted to a vehicle, the first actuator comprises a double acting hydraulic cylinder having an extensible and retractable rod, and the first actuator comprises a valve for controlling operations of the double acting hydraulic cylinder, the processor is operatively connected to the valve to control operations of the valve based on the current position information received from the position signal receiver and the predetermined positional data stored in the memory device, and the ground marking system further comprises a movable frame that is attached to the rod of the actuator and that includes a position signal receiver holder and a paint supply holder for mounting the position signal receiver in a fixed relative position with respect to the paint supply such that the position signal receiver moves with the paint supply in both of the first direction and the second direction.

12. The ground marking system of claim 11, wherein the position signal receiver is a global navigation satellite system (GNSS) receiver.

13. The ground marking system of claim 11, wherein the movable frame includes a skid mounted between the paint supply and the ground beneath the paint supply, the skid forming a paint aperture through which paint is discharged onto the ground beneath the skid.

14. The ground marking system of claim 11, further comprising:

a fixed frame, and a linearly-movable support bar extending between the fixed frame and the movable frame, wherein the linearly-movable support bar moves linearly within the fixed frame and substantially parallel with the rod of the double acting hydraulic cylinder.

15. The ground marking system of claim 14, further comprising a second hydraulic cylinder configured for selectively raising and lowering together each of the fixed frame, the movable frame, the double acting hydraulic cylinder and the linearly-movable support bar.

16. The ground marking system of claim 11, wherein the predetermined positional data is included in a CAD file stored in the memory device.

17. The ground marking system of claim 16, further comprising a display device operatively connected to the processor for displaying the CAD file; and a user interface operatively connected to the processor and configured for allowing a user to select the predetermined positional data from the displayed CAD file.

18. The ground marking system of claim 17, wherein the processor is configured to control operations of the valve based on the current position information received from the position signal receiver, the predetermined positional data stored in the memory device, and an offset distance, relative to the predetermined positional data, entered via the user interface.

19. The ground marking system of claim 11, wherein the second actuator comprises a solenoid configured to control the discharge of paint from the paint supply, the system further comprising a switch located within an operator compartment of the vehicle for controlling operations of the solenoid.

* * * * *